US011801594B2

(12) United States Patent
Otani et al.

(10) Patent No.: US 11,801,594 B2
(45) Date of Patent: Oct. 31, 2023

(54) POWER TOOL

(71) Applicant: MAKITA CORPORATION, Anjo (JP)

(72) Inventors: Ryosuke Otani, Anjo (JP); Junya Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/860,322

(22) Filed: Jul. 8, 2022

(65) Prior Publication Data

US 2023/0064399 A1 Mar. 2, 2023

(30) Foreign Application Priority Data

Aug. 26, 2021 (JP) ..... 2021-138295

(51) Int. Cl.
*B25F 5/00* (2006.01)
*B25F 5/02* (2006.01)

(52) U.S. Cl.
CPC ..... *B25F 5/026* (2013.01)

(58) Field of Classification Search
CPC ..... Y10S 16/90; B25F 5/024; B25F 5/026; B25F 5/02; B25F 5/006; B24B 23/00; B24B 23/005; B24B 29/00; B27B 9/00; B25G 1/06; B25G 1/00; B25G 3/38
See application file for complete search history.

(56) References Cited

U.S. PATENT DOCUMENTS 3,583,106 A * 6/1971 Dobbertin ..... B24B 27/08 30/390
3,620,269 A * 11/1971 Alfonso Lange ..... F16F 15/06 173/162.1
5,725,422 A * 3/1998 Leweck ..... B24B 23/005 451/359
6,484,361 B1 * 11/2002 Schmid ..... B25F 5/026 81/DIG. 12
6,725,491 B2 * 4/2004 Hung ..... B24B 23/005 15/97.1
6,810,547 B2 * 11/2004 Hung ..... A47L 11/4075 15/97.1
6,962,523 B2 * 11/2005 Fraser ..... B24B 23/005 451/259
7,392,568 B2 * 7/2008 Koschel ..... B25F 5/026 16/436
7,631,575 B2 * 12/2009 Gard ..... F16C 11/10 74/530
2002/0125022 A1 * 9/2002 Dieterle ..... B25F 5/026 173/170

(Continued)

FOREIGN PATENT DOCUMENTS

DE 3921752 A * 1/1991 ..... B24B 23/005
DE 102009029109 A1 * 3/2011 ..... B23D 51/01

(Continued)

*Primary Examiner* — Chuck Y Mah
(74) *Attorney, Agent, or Firm* — Oliff PLC

(57) ABSTRACT

A power tool includes a side handle that can be toollessly positioned and also attached to or detached from a tool body. The power tool includes a tool body having a side surface, a side handle on the side surface of the tool body, and an operable portion operable to attach or detach the side handle to or from the tool body and to position the side handle being attached to the tool body.

16 Claims, 15 Drawing Sheets

(56) References Cited

U.S. PATENT DOCUMENTS

| | | | | |
|---|---|---|---|---|
| 2003/0221292 | A1* | 12/2003 | Pozgay | B25F 5/02 409/182 |
| 2009/0178520 | A1* | 7/2009 | Engelfried | B25F 5/026 81/489 |
| 2010/0064482 | A1* | 3/2010 | Martin | B25F 5/026 16/426 |
| 2014/0112702 | A1* | 4/2014 | Mighells | B25F 5/02 403/92 |
| 2017/0265426 | A1* | 9/2017 | Nelson | A01K 1/0125 |
| 2019/0357436 | A1* | 11/2019 | Hamilton | A01B 1/026 |
| 2019/0364842 | A1* | 12/2019 | Nelson | F16C 11/10 |
| 2021/0060757 | A1* | 3/2021 | Swaminathan | B25F 5/001 |

FOREIGN PATENT DOCUMENTS

| | | | | | |
|---|---|---|---|---|---|
| EP | 1074351 | A1 | * | 2/2001 | B25F 5/026 |
| EP | 3395500 | A1 | * | 10/2018 | B24B 23/005 |
| GB | 2124536 | A | * | 2/1984 | B25D 17/04 |
| JP | 01135484 | A | * | 5/1989 | |
| JP | 2004261052 | A | * | 9/2004 | |
| WO | 01/019228 | A1 | | 3/2001 | |

* cited by examiner

POWER TOOL

CROSS-REFERENCE TO RELATED APPLICATIONS

This application claims the benefit of priority to Japanese Patent Application No. 2021-138295, filed on Aug. 26, 2021, the entire contents of which are hereby incorporated by reference.

BACKGROUND

1. Technical Field

The present disclosure relates to a power tool such as a polisher or a grinder.

2. Description of the Background

A power tool such as a polisher includes a side handle grippable by an operator. The side handle is attached to a side surface of a tool body. For example, WO 2001/19228 describes an electric tool including a looped side handle having its left and right ends rotatably screwed on the left and right side surfaces of the tool body. The side handle includes a lock knob rotational between positions at which the side handle is locked to be unrotatable relative to the tool body and unlocked to be rotatable. The lock knob is rotated to the unlocking position to allow angle adjustment of the side handle.

BRIEF SUMMARY

Although a known side handle can be positioned at the angle adjusted without using a tool such as a driver, attaching or detaching the side handle to or from the tool body includes the burden of using a tool for screwing and unscrewing a screw.

One or more aspects of the present disclosure are directed to a power tool including a side handle that can be toollessly positioned and also attached to or detached from a tool body.

A first aspect of the present disclosure provides a power tool, including:

a tool body having a side surface;

a side handle on the side surface of the tool body; and an operable portion operable to attach or detach the side handle to or from the tool body and to position the side handle being attached to the tool body.

The power tool according to the above aspect of the present disclosure includes the side handle that can be toollessly positioned and also attached to or detached from the tool body.

DETAILED DESCRIPTION

First Embodiment

Embodiments of the present disclosure will now be described with reference to the drawings.

Figure 1:
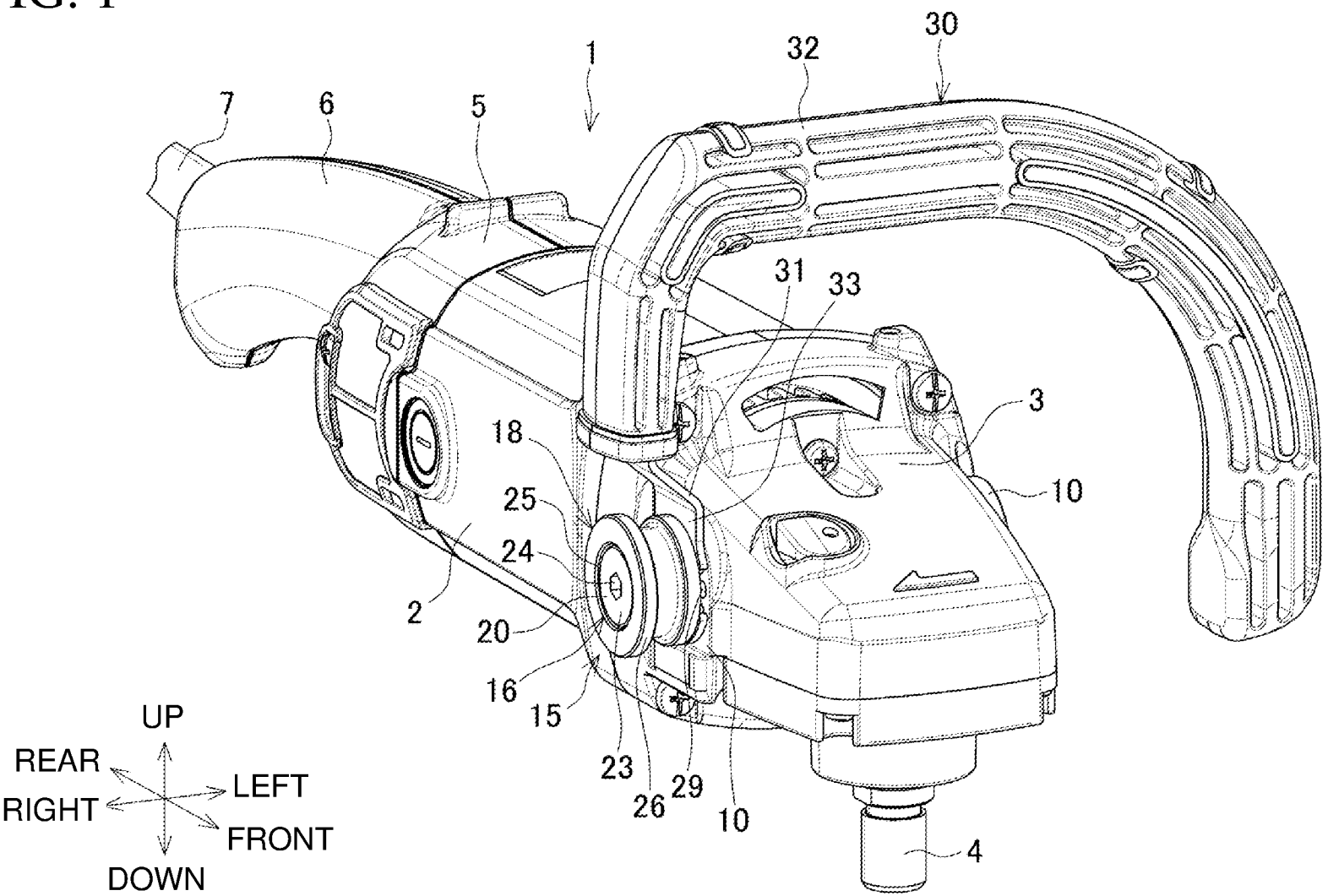
FIG. 1 is a perspective view of a polisher according to a first embodiment.
Figure 2:
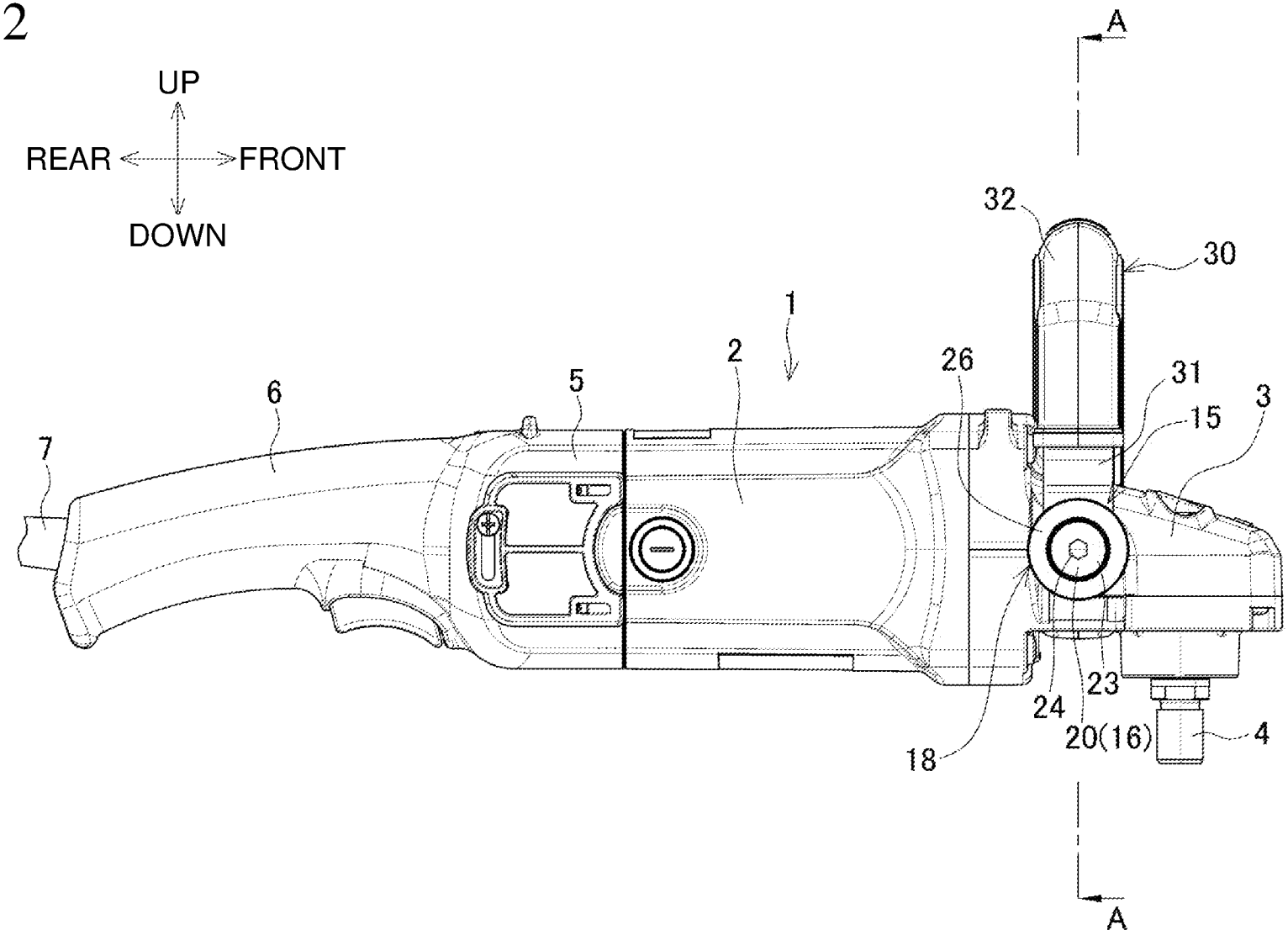
FIG. 2 is a side view of the polisher according to the first embodiment.
Figure 3:
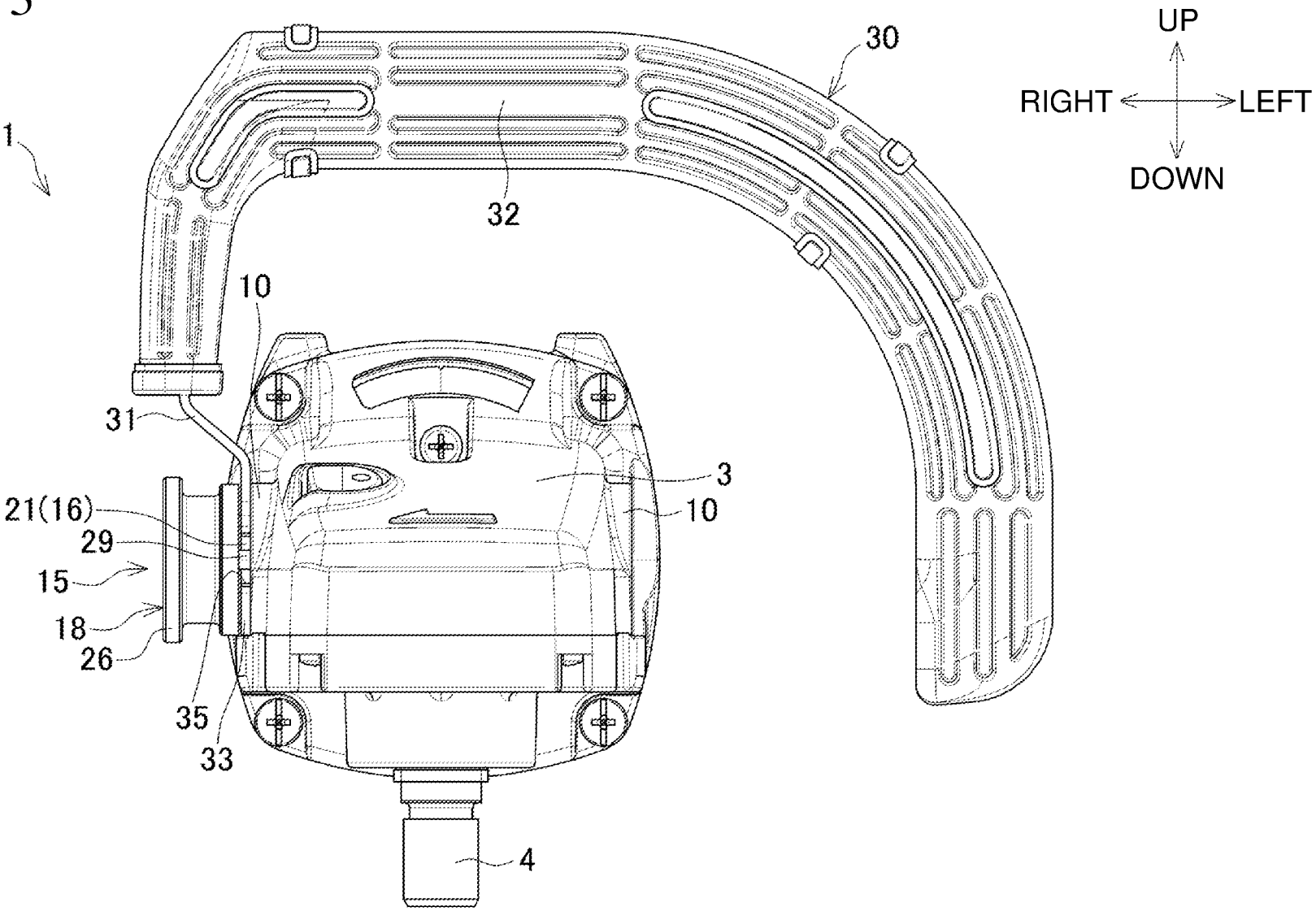
FIG. 3 is a front view of the polisher according to the first embodiment.

FIG. 1 is a perspective view of a polisher, or an example of a power tool. FIG. 2 is a side view of the polisher. FIG. 3 is a front view of the polisher.

The polisher 1 includes a motor housing 2 extending in the front-rear direction. The motor housing 2 accommodates a motor (not shown). A gear housing 3 is joined to the front of the motor housing 2. A spindle 4 protrudes downward from the gear housing 3. A disk-shaped tip tool (e.g., a pad, not shown) is orthogonally attachable to the lower end of the spindle 4.

A grip housing 5 is joined to the rear of the motor housing 2. The grip housing 5 includes a grip 6 extending rearward. The grip 6 has a smaller diameter. A power cable 7 is connected to the rear end of the grip 6.

Figure 4:
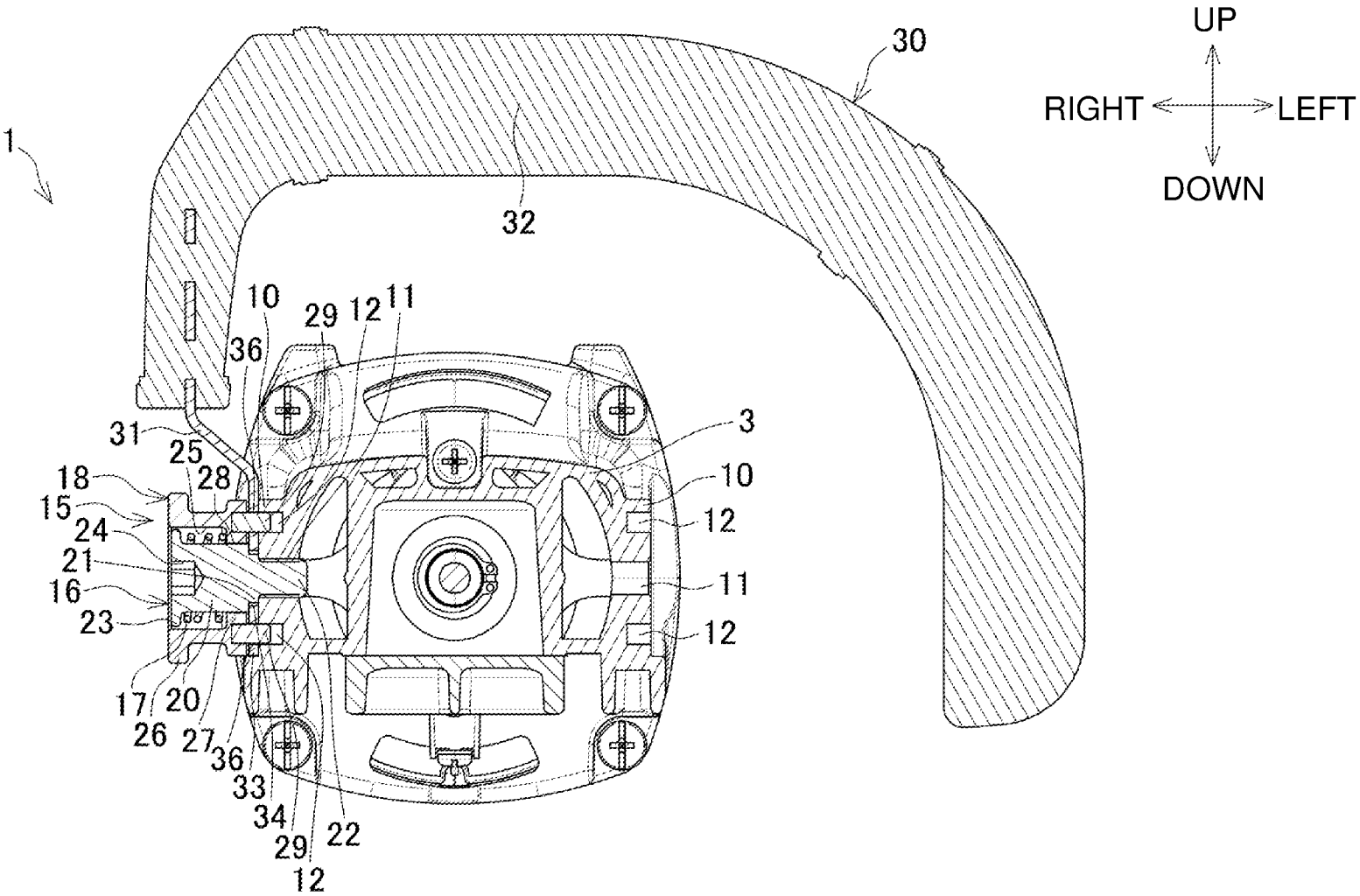
FIG. 4 is a cross-sectional view taken along line A-A in FIG. 2.
Figure 5:
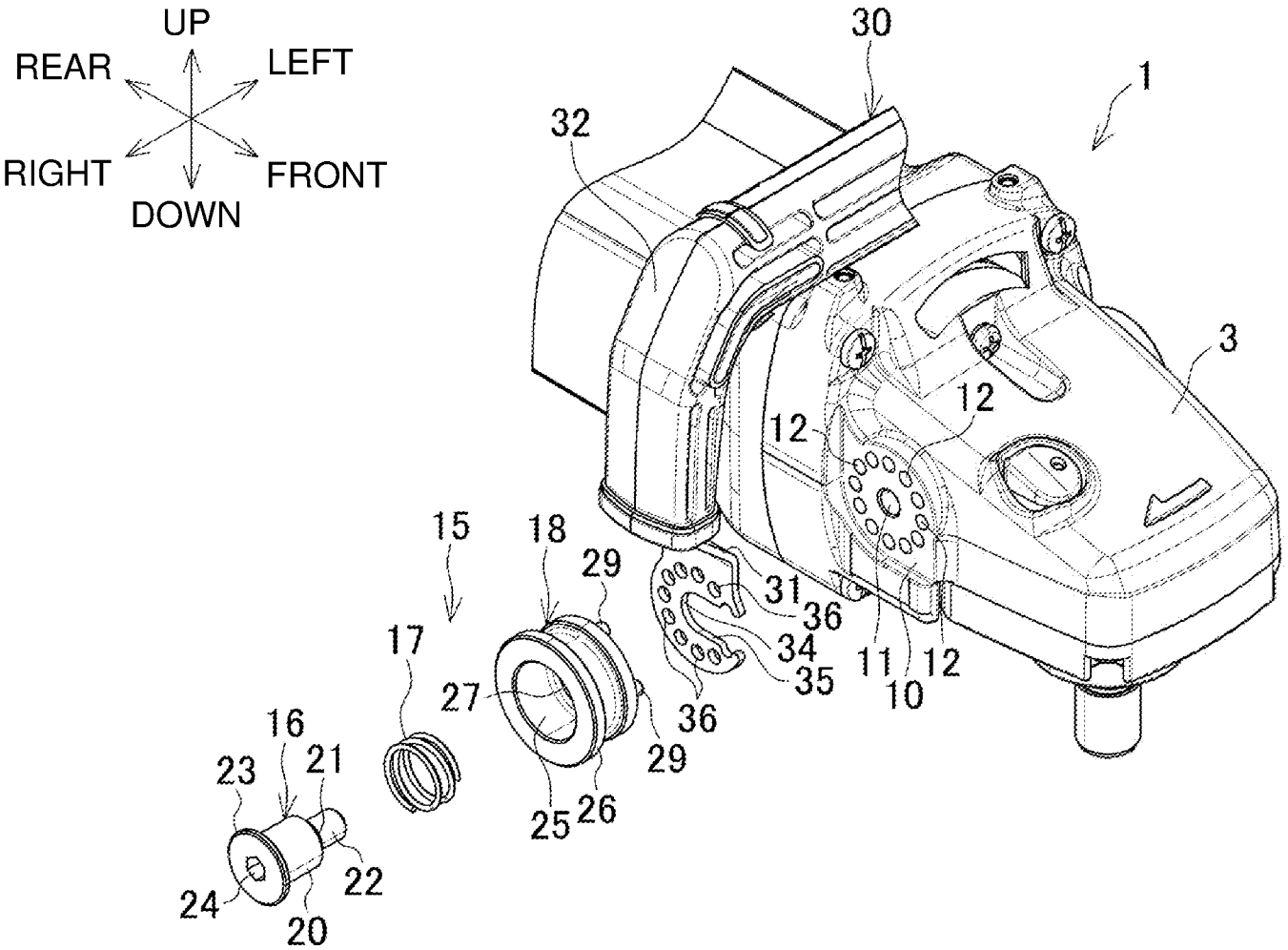
FIG. 5 is an exploded perspective view of an operable portion as viewed from the right.

As shown in FIGS. 4 and 5, planar mounts 10 for the side handle 30 protrude from left and right side surfaces of the gear housing 3. The protruding end face of each mount 10 is a plane defined by the front-rear and vertical directions. Each mount 10 has a threaded hole 11 at its center. Each mount 10 has multiple circular receiving holes 12 around the threaded hole 11. The receiving holes 12 are blind holes with a smaller diameter than the threaded hole 11. The multiple receiving holes 12 are located at equal intervals along the same circle centered at the threaded hole 11.

In the present embodiment, an operable portion 15 is mounted on the right mount 10. The side handle 30 is attachable to and detachable from the operable portion 15. The operable portion 15 is operable to adjust the angle of the attached side handle 30 about a lateral axis.

Figure 6:
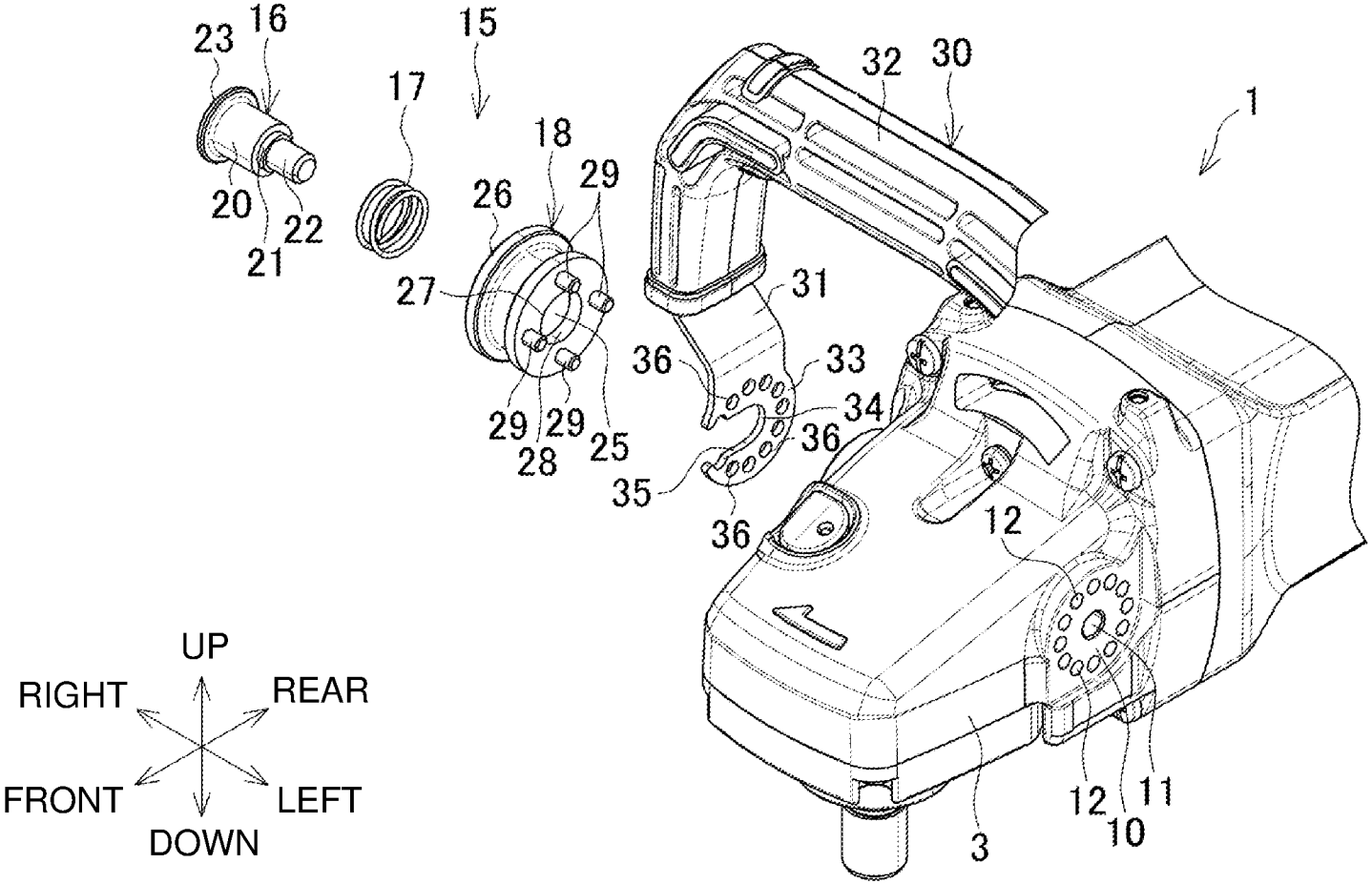
FIG. 6 is an exploded perspective view of the operable portion as viewed from the left.

As shown in FIGS. 5 and 6, the operable portion 15 includes a mount shaft 16, a coil spring 17, and a control knob 18.

The mount shaft 16 includes a larger-diameter portion 20, an intermediate-diameter portion 21, and a threaded portion 22 that are coaxially arranged in this order from the right. A flange 23 is located at the right end outer circumference of the larger-diameter portion 20. The larger-diameter portion 20 has a hexagon socket 24 at the center of its right end surface. The intermediate-diameter portion 21 is shorter than the larger-diameter portion 20 in the axial direction. The threaded portion 22 has a smaller diameter than the intermediate-diameter portion 21 and is screwable into the threaded hole 11 in the mount 10.

The coil spring 17 is externally mounted on the larger-diameter portion 20 on the left of the flange 23.

The control knob 18 is cylindrical and has an insertion hole 25. The insertion hole 25 receives the mount shaft 16 placed from the right. A flange-shaped hold 26 extends the entire right end outer circumference of the control knob 18. A ring-shaped wall 27 is located on the left end inner circumference of the insertion hole 25. The wall 27 has a through-hole 28, into which the larger-diameter portion 20 is loosely placed.

Four engagement pins 29 are arranged on the left end face of the control knob 18. Each engagement pin 29 protrudes leftward. The four engagement pins 29 are arranged at equal intervals along the same circle centered at the through-hole 28. The engagement pins 29 are placeable in the receiving holes 12 in the mount 10.

The mount shaft 16 is placed into the insertion hole 25 from the right of the control knob 18. The threaded portion 22 protruding from the through-hole 28 is then screwed into the threaded hole 11 in the mount 10 to attach the mount shaft 16 to the mount 10. In this attached state, the intermediate-diameter portion 21 is in contact with the end face of the mount 10.

The right end of the coil spring 17 is in contact with the flange 23 on the mount shaft 16. The left end of the coil spring 17 is in contact with the wall 27 of the control knob 18. Thus, the coil spring 17 is compressed in the axial direction. The control knob 18 is thus urged to an engagement position at which the four engagement pins 29 are simultaneously placed into the four receiving holes 12.

In this state, an operator can remove the engagement pins 29 from the receiving holes 12 by pulling the control knob 18 rightward against the urge of the coil spring 17 using the hold 26. The operator can insert the engagement pins 29 into the receiving holes 12 by rotating the control knob 18 about the mount shaft 16 until the engagement pins 29 are circumferentially aligned with the receiving holes 12.

The side handle 30 has an inverted U shape in a front view. The side handle 30 has left and right end portions extending vertically, and an upper portion extending laterally. The side handle 30 is asymmetrical or has the left end portion less steeply connected with an upper portion than the right end portion. The right end portion of the side handle 30 receives a metal plate 31 at its lower end. The upper end of the right end portion, the upper portion, and the left end portion of the side handle 30 are an integral resin portion 32.

The metal plate 31 has its upper end insert-molded in the resin portion 32 and extending downward, and has its lower end being a joint 33 that is circular in a side view defined in the front-rear and vertical directions. The joint 33 has, at the center, a through-hole 34 that allows the intermediate-diameter portion 21 of the mount shaft 16 to be fitted through. The joint 33 has a radial cutout portion 35 connected with the through-hole 34. The cutout portion 35 is wider than the diameter of the intermediate-diameter portion 21.

This allows the intermediate-diameter portion 21 to be relatively in and out of the through-hole 34 through the cutout portion 35. The intermediate-diameter portion 21 is located in the through-hole 34 to allow the joint 33 to be rotatable about the intermediate-diameter portion 21.

The joint 33 has multiple circular engagement holes 36. The engagement holes 36 are arranged at equal intervals along the same circle centered at the through-hole 34. The number of engagement holes 36 and their arrangement are the same as the number of receiving holes 12 in the mount 10 and their arrangement.

Figure 7:
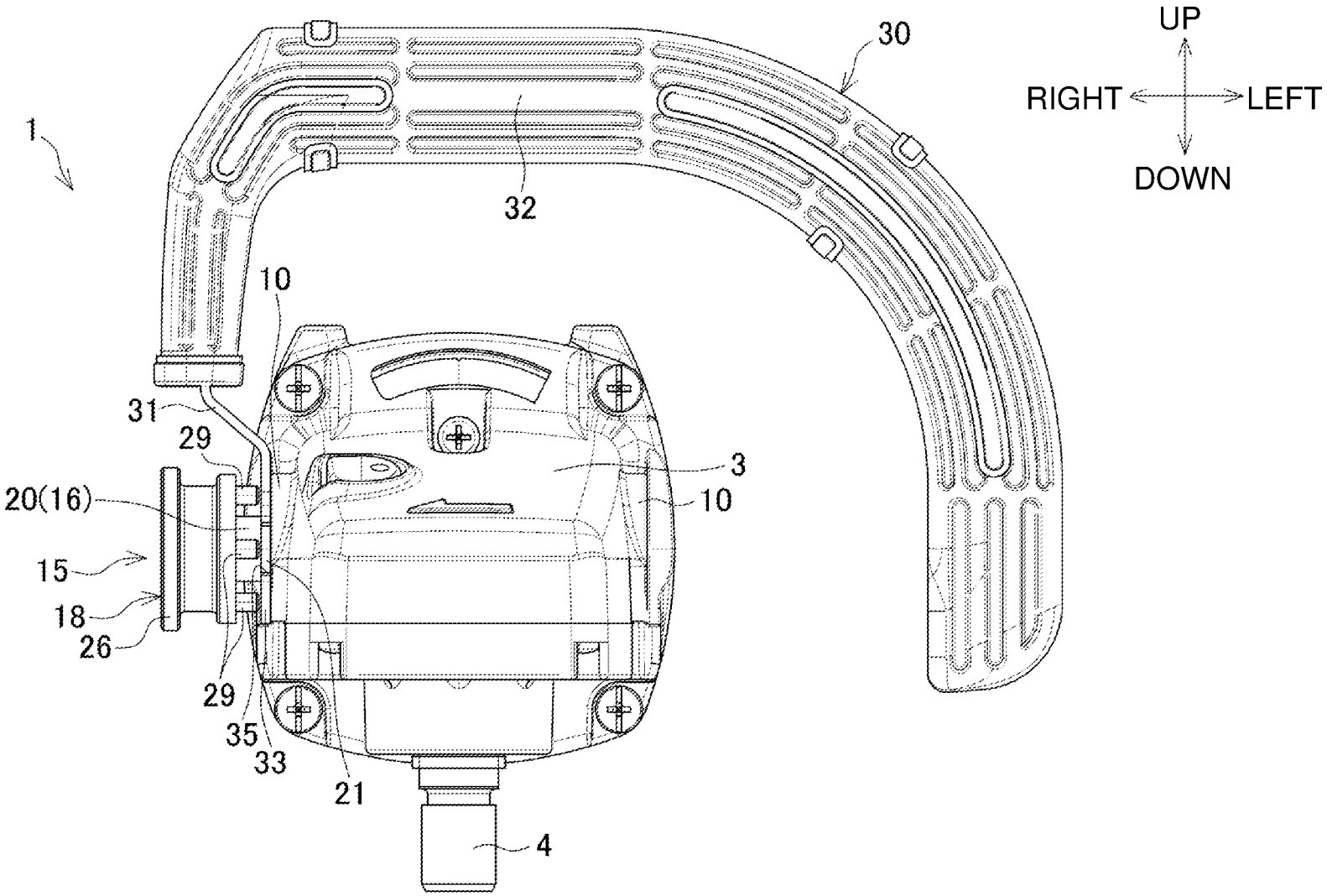
FIG. 7 is a front view of the polisher in an unlocked state after a pull of a control knob.

To attach the side handle 30 to the mount 10 as shown in FIG. 7, the operator first pulls the control knob 18 rightward until the engagement pins 29 are removed from the receiving holes 12, and their tip ends are positioned to the right of the intermediate-diameter portion 21 of the mount shaft 16. At this disengagement position, the intermediate-diameter portion 21 has its radially outer end being exposed.

Figure 8:
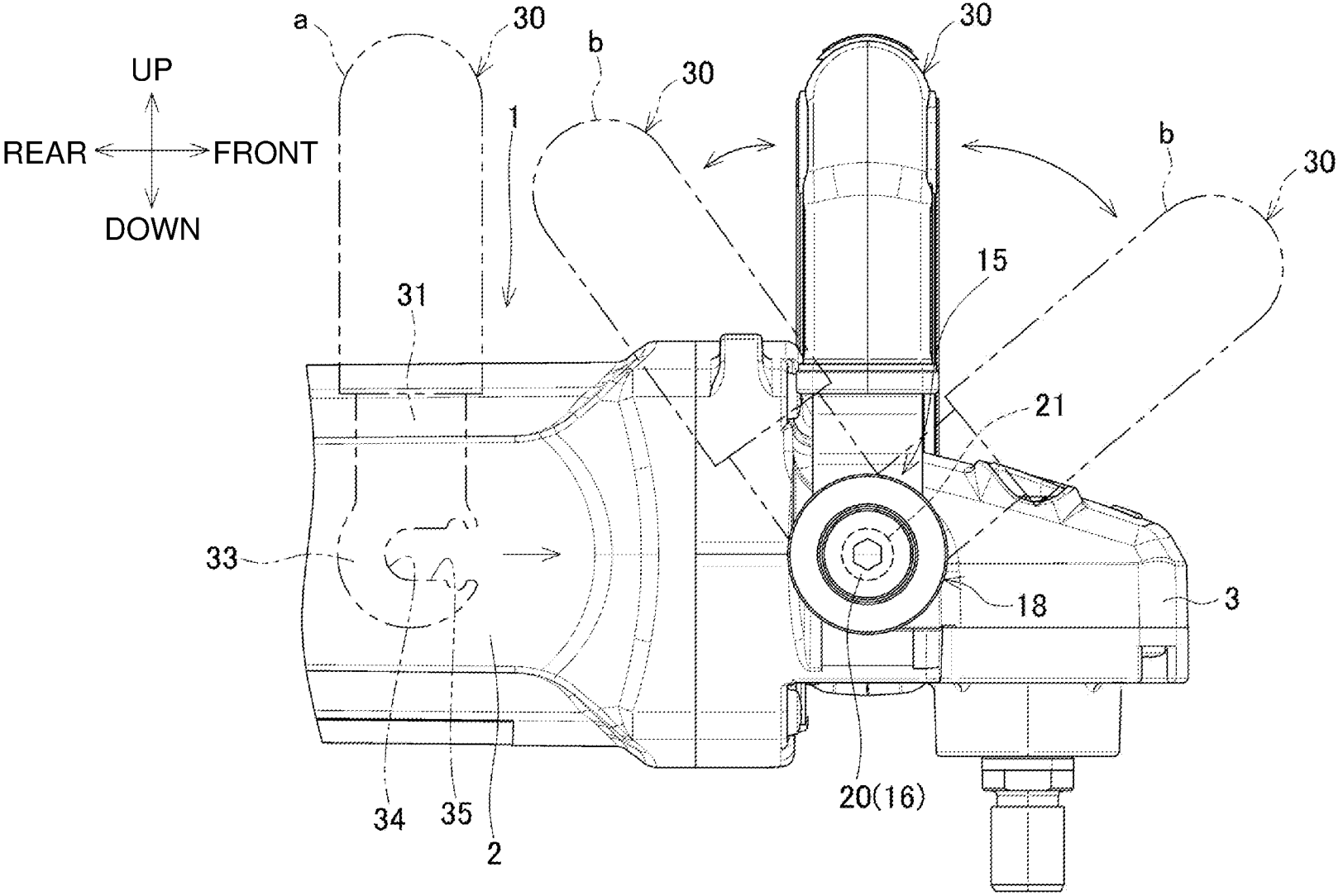
FIG. 8 is a side view of the polisher describing attachment and detachment and angle adjustment of a side handle.

In this state, as indicated with two-dot chain line a in FIG. 8, the operator slides the joint 33 in the metal plate 31 in the radial direction of the intermediate-diameter portion 21 to relatively move the intermediate-diameter portion 21 into the cutout portion 35. The intermediate-diameter portion 21 then reaches the through-hole 34 at the end of the cutout portion 35. Thus, the side handle 30 is rotatable about the mount shaft 16 at any angle in the front-rear direction without interfering with the motor housing 2 and the gear housing 3.

Once the angle is determined, the operator aligns the engagement holes 36 in the joint 33 with the receiving holes 12 in the mount 10 to release the pull of the control knob 18. Thus, the urge of the coil spring 17 moves the control knob 18 leftward, and the four engagement pins 29 are placed into the engagement holes 36 to be engaged with the receiving holes 12. Thus, the joint 33 is fixed between the mount 10 and the control knob 18 while being restricted from rotating about the mount shaft 16 by the engagement pins 29. Thus, the rotation of the side handle 30 is locked.

To change the angle of the side handle 30, the operator pulls the control knob 18 rightward to the disengagement position as described above. This allows, as indicated with two-dot chain lines b in FIG. 8, angle adjustment through rotation of the side handle 30 disengaged from the engagement pins 29 about the intermediate-diameter portion 21.

Similarly, to detach the side handle 30, the operator pulls the control knob 18 to the disengagement position and detaches the joint 33 from the intermediate-diameter portion 21.

When the operable portion 15 is attached to the left mount 10, the operator can similarly perform attachment and detachment and angle adjustment of the metal plate 31 by laterally inverting the side handle 30.

In this manner, in the polisher 1 according to the first embodiment, the operable portion 15 located in the gear housing 3 (tool body) allows attachment or detachment of the side handle 30 to or from the gear housing 3 and angle adjustment(positioning) of the gear housing 3 while being attached to the gear housing 3.

This structure allows toolless angle adjustment of the side handle 30 and also toolless attachment or detachment of the side handle 30 to or from the gear housing 3.

The operable portion 15 includes the mount shaft 16 located on the side surface of the gear housing 3. The side handle 30 includes the through-hole 34 (through-hole portion) through which the mount shaft 16 extends, and the cutout portion 35 that allows the mount shaft 16 to be relatively in and out of the through-hole 34 in the radial direction. Thus, the side handle 30 can be easily attached to and detached from the mount shaft 16.

The operable portion 15 includes the control knob 18 (operable member) movable relative to the mount shaft 16 in the axial direction. With the operation on the control knob 18 in the axial direction, the side handle 30 can be attached to and detached from the gear housing 3 and also undergo angle adjustment while being attached to the gear housing 3.

Thus, attachment and detachment and angle adjustment of the side handle 30 can be performed with a simple operation on the control knob 18 in the axial direction.

The side handle 30 includes, at positions decentered from the mount shaft 16, the engagement holes 36 (receiving portions) to which the control knob 18 is engageable in the rotation direction of the side handle 30 about the mount shaft 16 to restrict the rotation of the side handle 30. Thus, the control knob 18 can easily lock the rotation of the side handle 30.

The operable portion 15 includes a coil spring 17 (urging member) that urges the control knob 18 to an engagement position at which the control knob 18 is engaged with the side handle 30. When the control knob 18 is moved against the coil spring 17 to a disengagement position at which the control knob 18 is disengaged from the side handle 30, the side handle 30 is unlocked to be detachable and rotatable. When the control knob 18 is moved by the coil spring 17 to the engagement position at which the control knob 18 is engaged with the side handle 30, the side handle 30 is locked to be attached and unrotatable. Thus, when the operator releases the control knob 18 in the disengagement position, the side handle 30 is automatically locked to be attached and unrotatable.

The control knob 18 is movable to the disengagement position with an operation of pulling the control knob 18 away from the gear housing 3. The control knob 18 is simply operable.

The control knob 18 integrally includes the engagement pins 29 (engaging portions) to be engaged with the side handle 30. The control knob 18 is thus readily usable to restrict the rotation of the side handle 30.

The side handle 30 is laterally asymmetrical. The operable portion 15 is attachable to either a left portion or a right portion of the gear housing 3. Thus, the lateral orientation of the side handle 30 can be selected in accordance with the dominant hand of the operator or the operation state to increase operability.

In the first embodiment, the number of engagement pins or their positions are not limited to the above example. At least one engagement pin can position the side handle in the rotation direction. The number of receiving holes and the number of engagement holes and their positions are also changeable as well.

In the above example, each mount in the gear housing has the receiving holes, and the control knob includes the engagement pins. Conversely, the mount may include the engagement pins, and the control knob may have the receiving holes. In this case as well, when the operator pulls the control knob to the disengagement position at which the control knob is moved away from the ends of the engagement pins to form a gap that allows the joint in the side handle to move in, the operator can perform attachment and detachment and the angle adjustment of the side handle. The engagement pins are located on the gear housing, and the control knob may eliminate the receiving holes.

In the above example, the mounts are located on the left portion and the right portion of the gear housing to allow selective attachment of the side handle to the left portion or to the right portion, but the mount may be located on either the left portion or the right portion alone.

The side handle may be laterally symmetrical to receive the metal plates on the left and the right end portions. The side handle may also include the operable portions on the left and right mounts and may allow attachment and detachment and angle adjustment with the left and right operable portions.

The positions of the mounts of the side handle are not limited to the above example. The mounts may be located on a housing other than the gear housing.

Second Embodiment

A second embodiment will now be described. The components that are the same as in the first embodiment are denoted with the same reference numerals and will not be described repeatedly.

Figure 9:
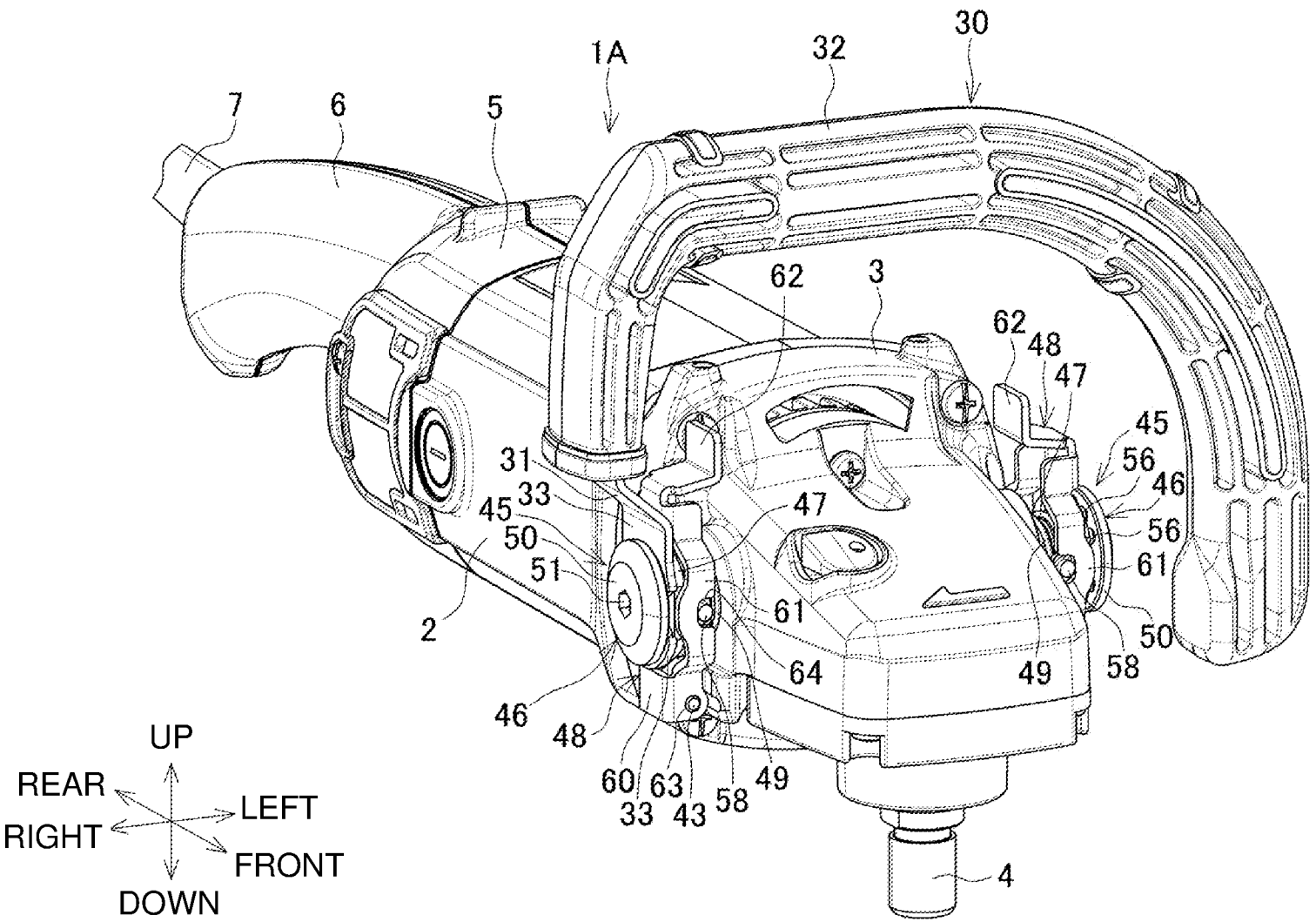
FIG. 9 is a perspective view of a polisher according to a second embodiment.
Figure 10:
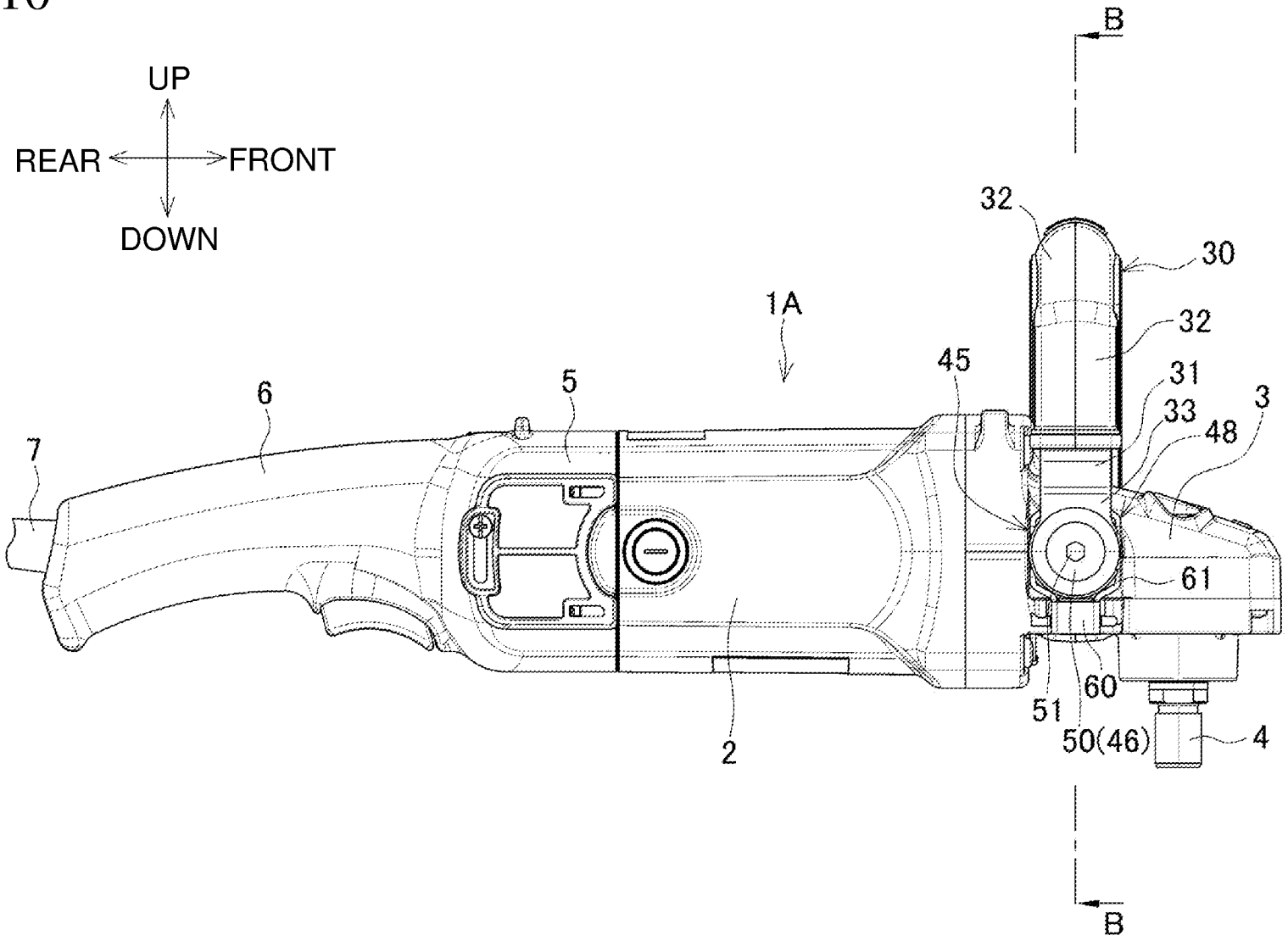
FIG. 10 is a side view of the polisher according to the second embodiment.
Figure 11:
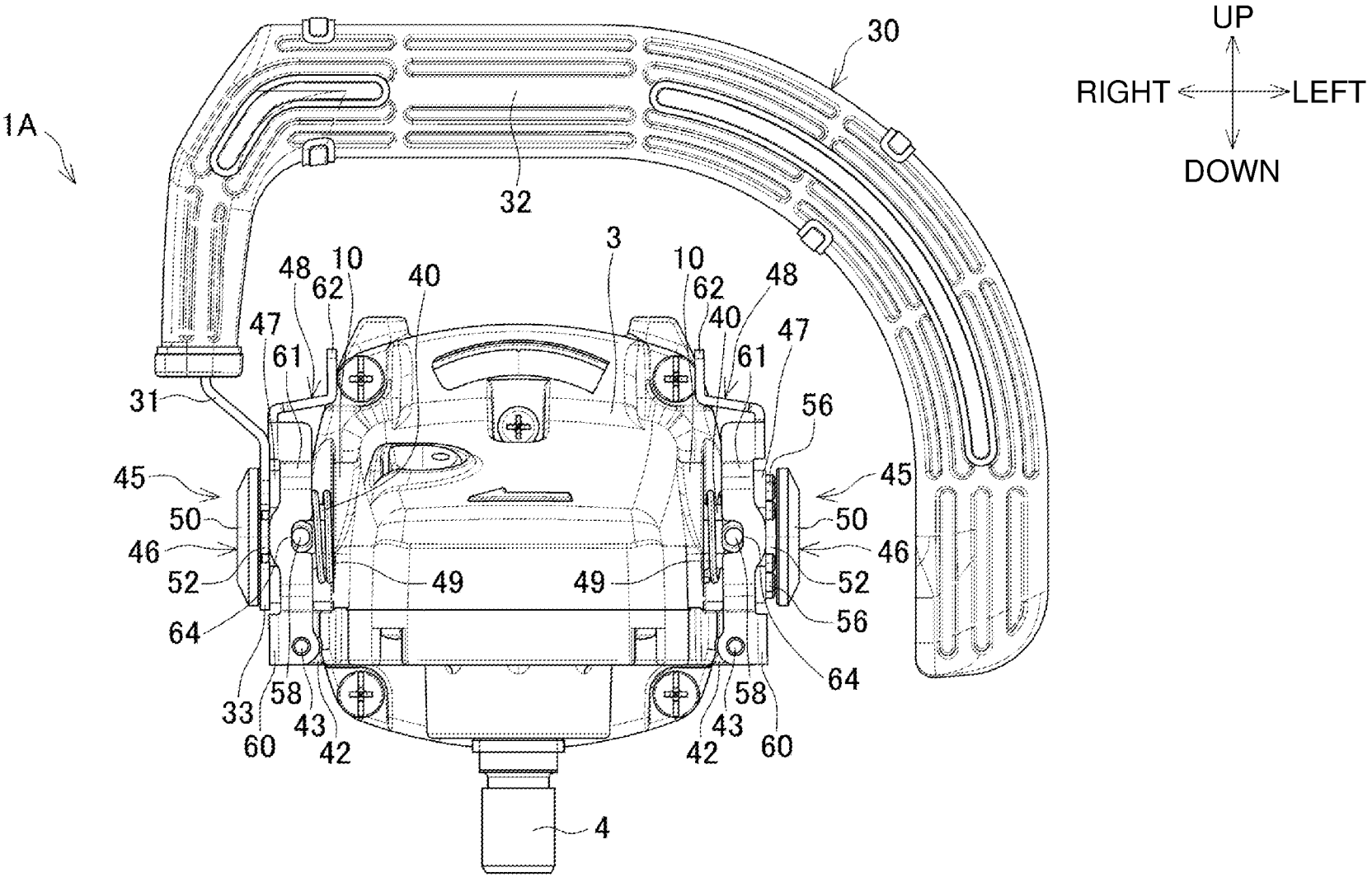
FIG. 11 is a front view of the polisher according to the second embodiment.

FIG. 9 is a perspective view of a polisher 1A according to the present embodiment. FIG. 10 is a side view of the polisher 1A according to the present embodiment. FIG. 11 is a front view of the polisher 1A according to the present embodiment.

Figure 12:
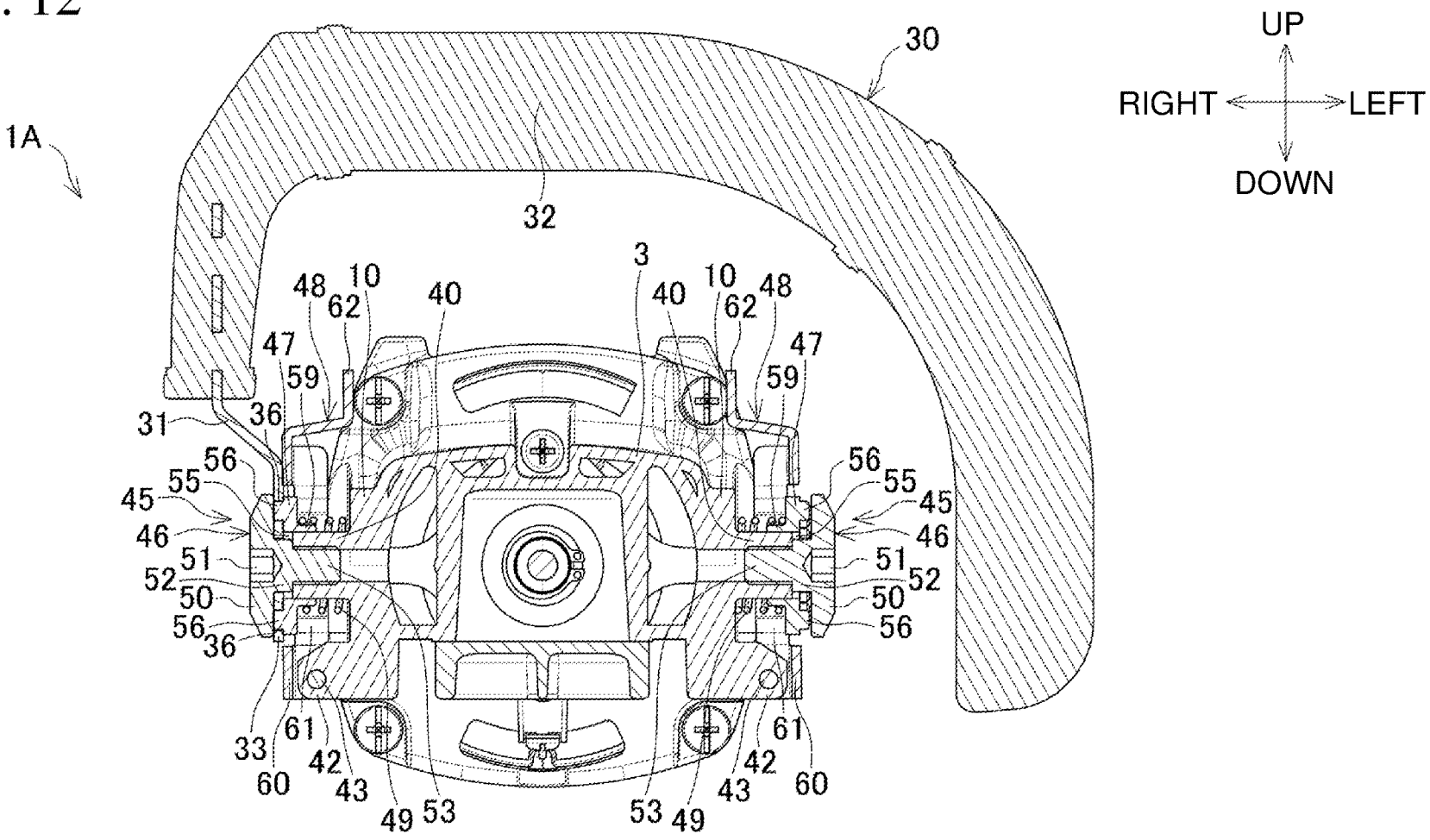
FIG. 12 is a cross-sectional view taken along line B-B in FIG. 10.
Figure 13:
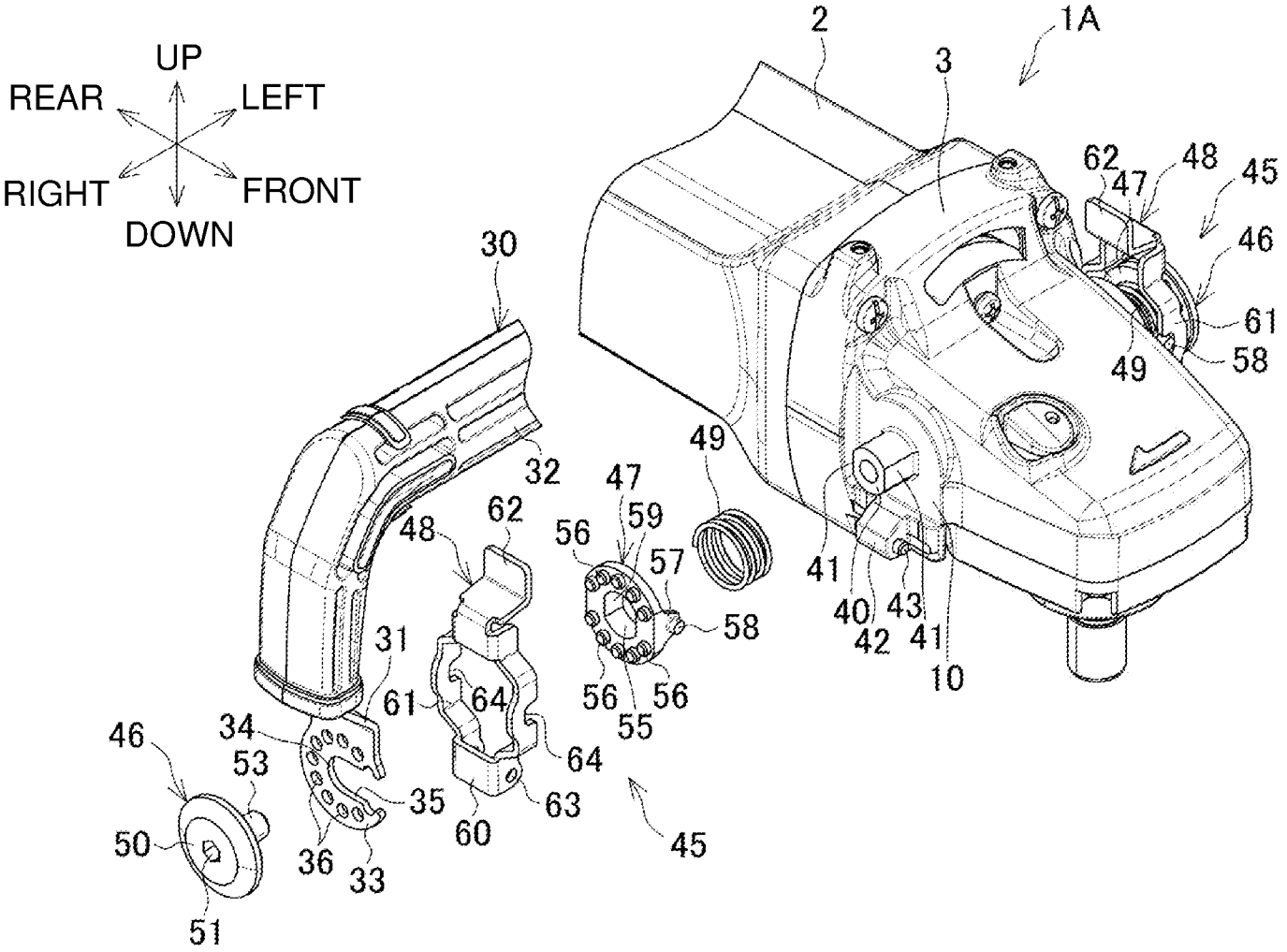
FIG. 13 is an exploded perspective view of an operable portion as viewed from the right.

As shown in FIGS. 12 and 13, the polisher 1A includes screw bosses 40 at the centers of the left and right mounts 10 in the gear housing 3. The screw bosses 40 protrude outward to the left and the right. Each screw boss 40 has a threaded hole at its center. The outer circumferential surface of the screw boss 40 includes flat edges 41 parallel to each other on the front and the rear.

Supports 42 are located on the side surfaces of the gear housing 3 below the mounts 10. Each support 42 receives a pin 43 placed in the front-rear direction. Each pin 43 has its two ends protruding from the front and rear surfaces of the corresponding support 42.

Operable portions 45 are mounted on the respective left and right mounts 10. The left and right operable portions 45 are symmetrical to each other. The right operable portion 45 will be described below.

Figure 14:
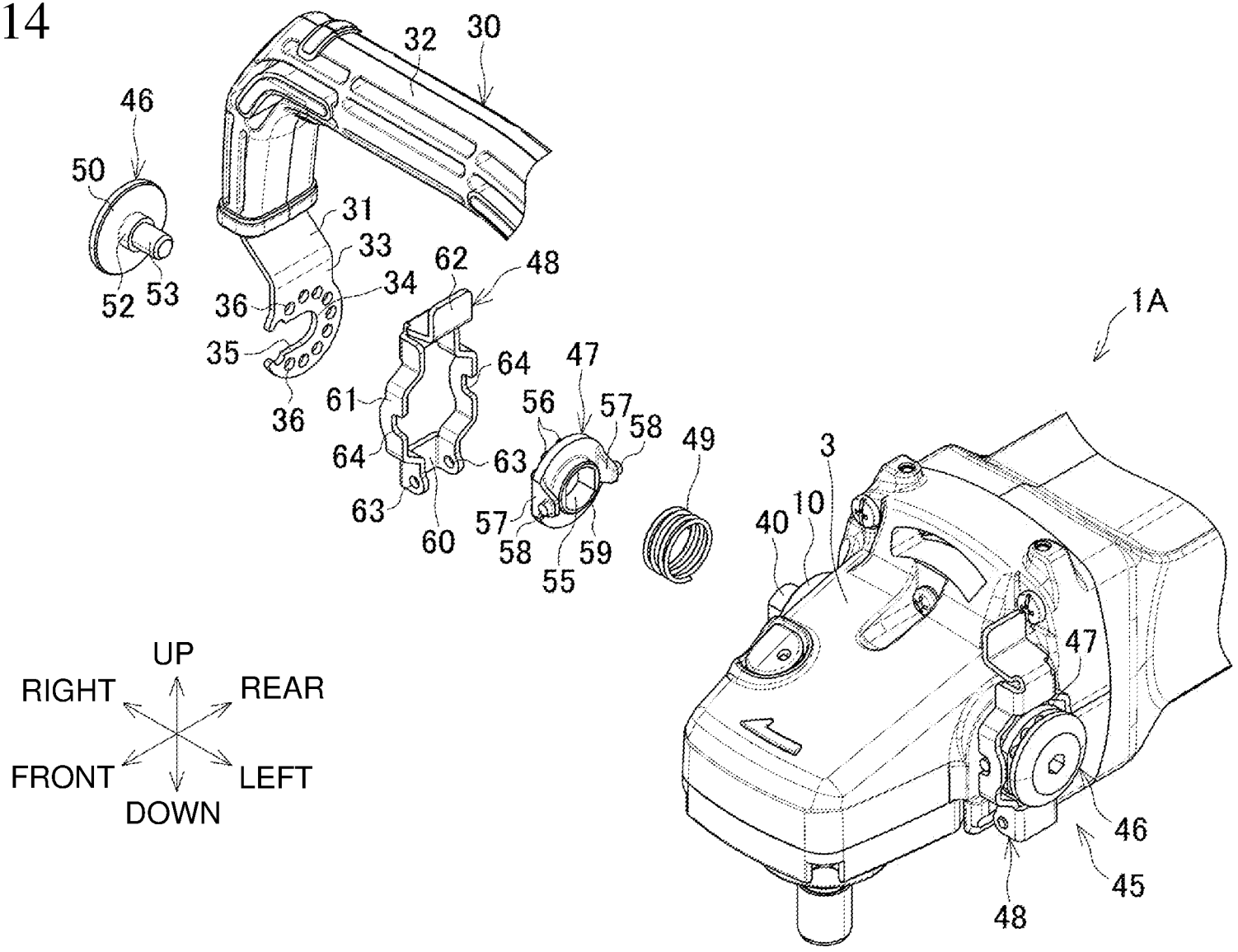
FIG. 14 is an exploded perspective view of the operable portion as viewed from the left.

As shown in FIG. 14, the operable portion 45 includes a mount shaft 46, an engagement plate 47, a control lever 48, and a coil spring 49.

The mount shaft 46 includes a circular head 50 with a large diameter at its right end. The circular head 50 has a hexagon socket 51 at the center of its right end surface. An intermediate-diameter portion 52 with a smaller diameter than the circular head 50 is coaxially located on the left of the circular head 50. A thread portion 53 with a smaller diameter than the intermediate-diameter portion 52 is located on the left of the intermediate-diameter portion 52. The thread portion 53 is screwable into the screw boss 40.

The engagement plate 47 has a ring shape in a side view. The engagement plate 47 has, at its center, a fitting hole 55 with a width across flats corresponding to the profile of the screw boss 40. The engagement plate 47 has multiple engagement projections 56 on its right end face. The engagement projections 56 are circular in a side view. The engagement projections 56 are arranged at equal intervals along the same circle centered at the fitting hole 55. The engagement projections 56 correspond to and are engageable with the engagement holes 36 in the joint 33.

The engagement plate 47 has a pair of folded tabs 57 that protrude leftward on the front and rear surfaces. The folded tab 57 on the front surface includes a stopper protrusion 58 protruding frontward. The folded tab 57 on the rear surface has a stopper protrusion 58 protruding rearward. The pair of folded tabs 57 are coaxial with each other. With the fitting hole 55 fitted to the screw boss 40, the engagement plate 47 is restricted from rotating and is laterally slidable along the screw boss 40. The engagement plate 47 includes a cylinder 59 on the left end surface. The cylinder 59 protrudes leftward between the pair of folded tabs 57.

The control lever 48 includes a shaft support 60, a frame 61, and an operation tab 62. The shaft support 60 has a U shape in a plan view and has both ends extending leftward.

The shaft support 60 is attached to the support 42 in the mount 10 from the right. The shaft support 60 has small holes 63 at both ends. The pin 43 received in the supports 42 extends through the small holes 63. Thus, the control lever 48 is supported to be laterally swingable about the pin 43 with the shaft support 60 attached to the supports 42.

The frame 61 is integral with an upper portion of the shaft support 60. The frame 61 is circular in a side view with a larger diameter than the engagement plate 47. The frame 61 has stopper recesses 64 on both front and rear surfaces. The stopper recesses 64 are engaged with the stopper protrusions 58 on the engagement plate 47 from the right.

The operation tab 62 is integral with an upper portion of the frame 61. The operation tab 62 has an L shape in a front view with its upper end extending upward.

The coil spring 49 is externally mounted on the screw boss 40 on the left of the engagement plate 47. The left end of the coil spring 49 is in contact with the mount 10. The right end of the coil spring 49 is externally mounted on the cylinder 59 in the engagement plate 47 and in contact with the left end face of the engagement plate 47.

In the operable portion 45, the coil spring 49 is externally mounted on the screw boss 40 and the engagement plate 47 is fitted to the screw boss 40, and the shaft support 60 in the control lever 48 is attached to the support 42. The thread portion 53 of the mount shaft 46 is then placed through the engagement plate 47 in the frame 61 from the right of the frame 61 and is screwed into the screw boss 40. The intermediate-diameter portion 52 then comes into contact with the right end face of the screw boss 40.

In this state, the engagement plate 47 is pressed by the urge of the coil spring 49 to a position (engagement position) at which the engagement projections 56 come into contact with the left end face of the circular head 50 of the mount shaft 46. Thus, the control lever 48 is moved to a rightward swing position at which the frame 61 with which the stopper protrusions 58 on the engagement plate 47 are engaged is pushed rightward. At the rightward swing position, the operation tab 62 is spaced from the right side surface of the gear housing 3.

Figure 15:
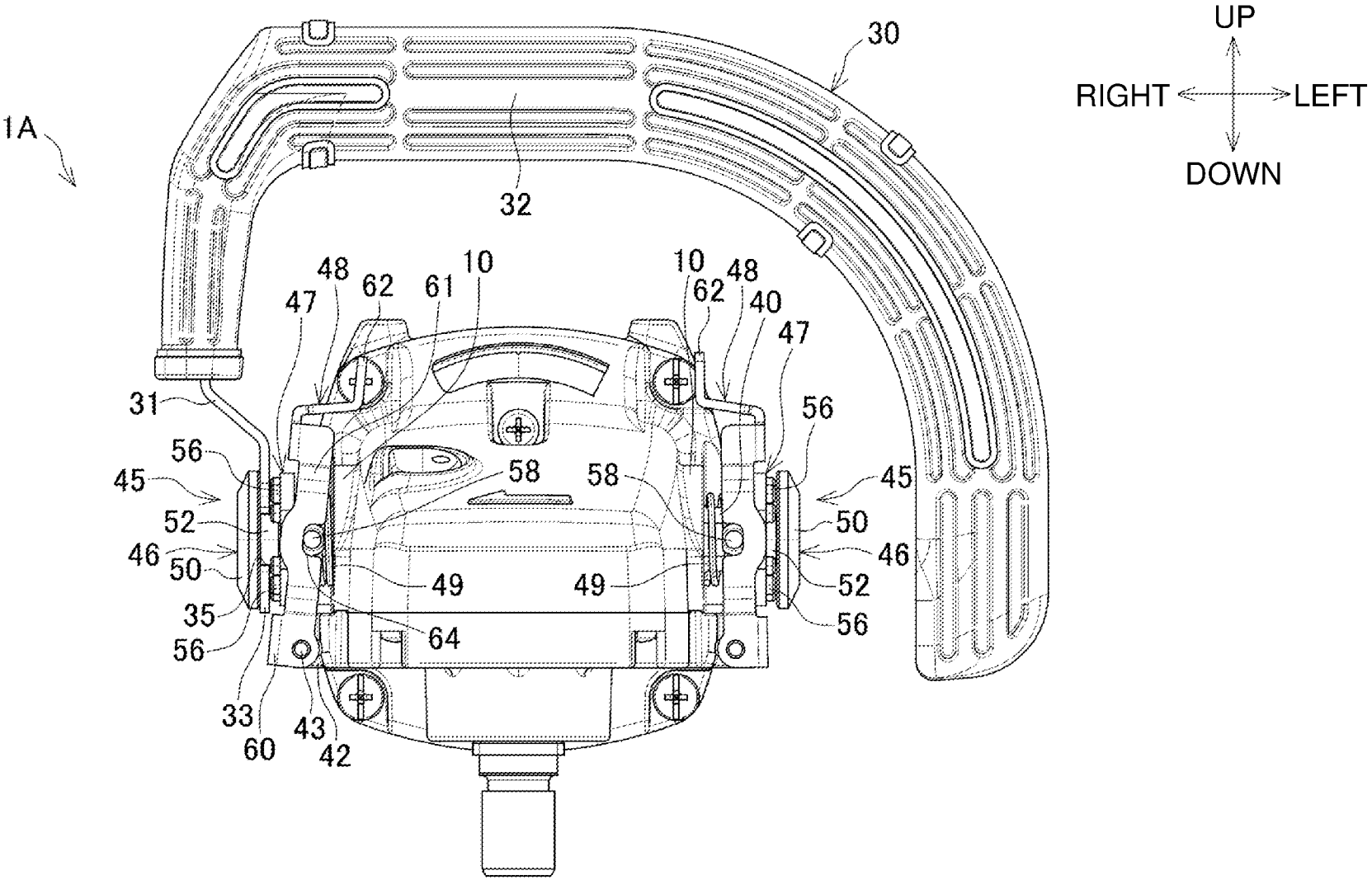
FIG. 15 is a front view of the polisher in an unlocked state after a push on a control lever.

To attach the side handle 30 to the mount 10, the right operation tab 62 is first pushed leftward as shown in FIG. 15. The control lever 48 then swings leftward about the pin 43 against the urge of the coil spring 49. Thus, the frame 61 slides the engagement plate 47 leftward with the stopper protrusions 58 in between, and the engagement projections 56 move away from the circular head 50. At this disengagement position, the intermediate-diameter portion 52 has the radially outer end being exposed.

The operator slides the joint 33 in the metal plate 31 in the radial direction of the intermediate-diameter portion 52 to relatively move the intermediate-diameter portion 52 into the cutout portion 35 in the same manner as indicated with two-dot chain line a in FIG. 8. The intermediate-diameter portion 52 then reaches the through-hole 34 at the end of the cutout portion 35. The side handle 30 is rotatable about the mount shaft 46 at any angle in the front-rear direction without interfering with the motor housing 2 and the gear housing 3 in the same manner as indicated with two-dot chain lines b in FIG. 8.

Once the angle is determined, the push on the operation tab 62 is released. The urge of the coil spring 49 then returns the control lever 48 to the rightward swing position and engages the engagement projections 56 with the engagement holes 36 in the joint 33. Thus, the joint 33 is secured between the circular head 50 and the engagement plate 47 while being restricted by the engagement projections 56 from rotating about the mount shaft 46. The rotation of the side handle 30 is locked.

To change the angle of the side handle 30, the operator pushes the operation tab 62 leftward to swing the control lever 48 to the disengagement position as described above. The operator can then adjust the angle by rotating the side handle 30 disengaged from the engagement projections 56 about the intermediate-diameter portion 52. To detach the side handle 30 as well, the operator can readily detach the side handle 30 from the intermediate-diameter portion 52 by swinging the control lever 48 to the disengagement position with the operation tab 62 in between.

The operable portion 45 is also mounted on the left mount 10. Thus, the operator can similarly perform attachment and detachment and angle adjustment of the joint 33 by laterally inverting the side handle 30.

In the polisher 1A according to the second embodiment as well, the operable portion 45 located in the gear housing 3 is operable to attach or detach the side handle 30 to or from the gear housing 3 and adjust the angle of (position) the side handle 30 while the side handle 30 being attached to the gear housing 3.

This structure allows toolless angle adjustment of the side handle 30 and also toolless attachment or detachment of the side handle 30 to or from the gear housing 3.

The operable portion 45 includes a control lever 48 (operable member) having a first end rotatably connected to the gear housing 3. The second end of the control lever 48 can be swung about the first end to attach or detach the side handle 30 to or from the gear housing 3 and adjust the angle of the side handle 30 while the side handle 30 being attached. A simple swing of the control lever 48 allows attachment and detachment and the angle adjustment of the side handle 30.

In the second embodiment, the control lever 48 may be located in a direction other than in the vertical direction. For example, the control lever 48 may be located in horizontally in the front-rear direction with the shaft support at the rear end and the operation tab at the front end. The control lever may be located obliquely.

In the second embodiment, the mounts and the operable portions are located on the left portion and the right portion of the gear housing to allow selective attachment of the side handle to the left or the right, but the mount and the operable portion may be located on either the left alone or the right alone.

The side handle may be laterally symmetrical to receive the metal plates on the left and the right end portions. The side handle may allow attachment and detachment and angle adjustment with the left and right operable portions.

The positions of the mounts for the side handle are not limited to the above example. The mounts may be located on a housing other than the gear housing.

In the above embodiments, the side handle may have a shape other than an inverted U shape in a front view. For example, the side handle may have an inverted L shape having an upper portion extending horizontally. The side handle may be entirely formed from metal or resin.

The positioning of the side handle is not limited to the angle adjustment. The positioning in the present disclosure includes a change of an attachment position of the side handle through, for example, sliding the side handle in an intended direction.

In each embodiment, the operable portion is located on the tool body, but the operable portion may be located on the side handle.

Instead of an alternating-current (AC) tool, the power tool may be a direct-current (DC) tool powered by, for example, a battery pack.

The power tool may be a device other than a polisher. The present disclosure is also applicable to a grinding tool or a polishing tool such as a sander or a grinder, and a cutting tool such as a circular saw or a cutter. Thus, the power tool is not limited to an electric tool. The present disclosure is also applicable to, for example, an air tool or an engine tool.

REFERENCE SIGNS LIST

1, 1A polisher
2 motor housing
3 gear housing
4 spindle
10 mount
11 threaded hole
12 receiving hole
15, 45 operable portion
16, 46 mount shaft
17, 49 coil spring
18 control knob
21, 52 intermediate-diameter portion
22, 53 thread portion
29 engagement pin
30 side handle
31 metal plate
33 joint
34 through-hole
35 cutout portion
36 engagement hole
40 screw boss
42 support
43 pin
47 engagement plate
48 control lever
56 engagement projection
62 operation tab

What is claimed is:

1. A power tool, comprising:
a tool body having a side surface;
a side handle on the side surface of the tool body; and
an operable portion operable to attach or detach the side handle to or from the tool body and to position the side handle being attached to the tool body, wherein
the operable portion includes a mount shaft on the side surface of the tool body, and
the side handle includes
a through-hole portion through which the mount shaft extends, and
a cutout portion allowing the mount shaft to be relatively in and out of the through-hole portion in a radial direction.

2. The power tool according to claim 1, wherein
the tool body includes the operable portion.

3. The power tool according to claim 2, wherein
the operable portion includes an operable member having a first end rotatably connected to the tool body, and
the side handle is attached to or detached from the tool body in response to a swing of a second end of the operable member about the first end, and the side handle being attached to the tool body is positioned in response to a swing of the second end of the operable member about the first end.

4. The power tool according to claim 2, wherein
the side handle is laterally asymmetrical, and
the operable portion is attachable to a left portion or a right portion of the tool body.

5. The power tool according to claim 1, wherein
the side handle includes the operable portion.

6. The power tool according to claim 5, wherein
the operable portion includes an operable member having a first end rotatably connected to the tool body, and
the side handle is attached to or detached from the tool body in response to a swing of a second end of the operable member about the first end, and the side handle being attached to the tool body is positioned in response to a swing of the second end of the operable member about the first end.

7. The power tool according to claim 1, wherein
the operable portion includes an operable member movable relative to the mount shaft in an axial direction, and
the side handle is attached to or detached from the tool body in response to an operation on the operable member in the axial direction, and the side handle being attached to the tool body is positioned in response to an operation on the operable member in the axial direction.

8. The power tool according to claim 7, wherein
the side handle includes, at a position decentered from the mount shaft, a receiving portion to be engaged with the operable member and positioned in a rotation direction of the side handle about the mount shaft.

9. The power tool according to claim 8, wherein
the operable portion includes an urging member to urge the operable member to an engagement position at which the operable member is engaged with the side handle,
the side handle is detached and is out of position in response to the operable member moved against the urging member to a disengagement position at which the operable member is disengaged from the side handle, and
the side handle is attached and is positioned in response to the operable member moved by the urging member to the engagement position.

10. The power tool according to claim 9, wherein
the operable member is movable to the disengagement position with an operation of pulling the operable member away from the tool body.

11. The power tool according to claim 10, wherein
the operable member is integral with an engaging portion engageable with the side handle.

12. The power tool according to claim 9, wherein
the operable member is integral with an engaging portion engageable with the side handle.

13. The power tool according to claim 8, wherein
the operable member is integral with an engaging portion engageable with the side handle.

14. The power tool according to claim 8, wherein
the operable portion includes an operable member having a first end rotatably connected to the tool body, and
the side handle is attached to or detached from the tool body in response to a swing of a second end of the operable member about the first end, and the side handle being attached to the tool body is positioned in response to a swing of the second end of the operable member about the first end.

15. The power tool according to claim 1, wherein
the operable portion includes an operable member having a first end rotatably connected to the tool body, and the side handle is attached to or detached from the tool body in response to a swing of a second end of the operable member about the first end, and the side handle being attached to the tool body is positioned in response to a swing of the second end of the operable member about the first end.

16. The power tool according to claim 1, wherein the side handle is laterally asymmetrical, and the operable portion is attachable to a left portion or a right portion of the tool body.

* * * * *